US005644978A

United States Patent [19]

Jaenson et al.

[11] Patent Number: 5,644,978

[45] Date of Patent: Jul. 8, 1997

[54] WIRE TYING APPARATUS FOR DOWN-PACKER COTTON PRESS

[75] Inventors: Howard W. Jaenson, Covina; Bradley P. Actis, Rancho Cucamonga, both of Calif.

[73] Assignee: H.W.J. Designs for Agribusiness, Fontana, Calif.

[21] Appl. No.: 608,701

[22] Filed: Feb. 29, 1996

[51] Int. Cl.[6] ..... B65B 13/24

[52] U.S. Cl. ..... 100/8; 100/3; 100/25; 100/29; 100/33 R; 100/34; 100/223; 140/101

[58] Field of Search ..... 100/3, 8, 11, 16, 100/25, 26, 29, 33 R, 34, 223; 140/93 A, 101, 111

[56] References Cited

U.S. PATENT DOCUMENTS

| | | | |
|---|---|---|---|
| Re. 26,289 | 10/1967 | Neitzel et al. . | |
| 321,542 | 7/1885 | Sheppard | 100/29 |
| 1,198,689 | 9/1916 | Barnes | 100/29 |
| 1,732,619 | 10/1929 | Ryan . | |
| 1,947,918 | 2/1934 | Paxton . | |
| 2,612,833 | 10/1952 | MacChesney . | |
| 2,937,484 | 5/1960 | Wiman . | |
| 3,010,386 | 11/1961 | Sinclair et al. | 100/25 |
| 3,168,912 | 2/1965 | Marica . | |
| 3,213,780 | 10/1965 | Nietzel et al. . | |
| 3,279,355 | 10/1966 | Missioux . | |
| 3,477,363 | 11/1969 | Trumbo . | |
| 3,602,133 | 8/1971 | Neitzel et al. | 100/26 |
| 3,767,885 | 10/1973 | Fryer . | |
| 3,863,297 | 2/1975 | Simich . | |
| 3,863,558 | 2/1975 | Trumbo . | |
| 4,055,115 | 10/1977 | Simich . | |
| 4,353,295 | 10/1982 | Kandarian . | |
| 4,484,518 | 11/1984 | Jaenson | 100/33 R |
| 5,379,687 | 1/1995 | Moseley . | |
| 5,546,855 | 8/1996 | Van Doorn et al. | 100/33 R |

*Primary Examiner*—Stephen F. Gerrity
*Attorney, Agent, or Firm*—Christie, Parker & Hale, LLP

[57] ABSTRACT

A tying device is provided for mounting on a down-packer type baling press in which cotton is boxed for baling at a loading side of a substantially horizontal rotating turntable, the tying device for tying a plurality of wires having pre-formed interlocking ends around a bale formed in the press. The device includes a base plate provided as the floor of the press chamber in which the bale is formed and a pair of wire-bend assemblies pivotally mounted on opposite sides of the base plate. A wire closer assembly is mounted on the press ram above the bale and provides the top surface of the baling chamber. The wire bend assemblies pivot from a first fully retracted to a second partially extended load position and to a fully extended position so as to bend the pre-formed interlocking ends of the wires around the bale and to insert the interlocking ends into the wire closers where the interlocking ends are joined together to form a knot.

18 Claims, 11 Drawing Sheets

24
α
α
32
20

68
125
178
174
24
30a
30
177
176

24
146
144
32
145
140
30
141
146
135
136
24
114
114a

WIRE TYING APPARATUS FOR DOWN-PACKER COTTON PRESS

FIELD OF THE INVENTION

The invention relates to an apparatus and method useful for automatically tying a plurality of wires with pre-formed interlocking ends around a bale, and particularly to an automatic wire-tying apparatus for tying a plurality of wires around a bale formed in a down-packer type baling press.

BACKGROUND OF THE INVENTION

In the cotton industry, the normal method of banding or tying cotton bales has been to have workmen direct a tie, such as a band or wire, around a bale and then secure the ends of the ties appropriate depending on the design of the tie.

A manual-type bale-tying operation is described in U.S. Pat. No. 3,477,363 to Trumbo, the disclosure of which is expressly incorporated herein by reference.

Trumbo discloses that a bale, such as a bale of cotton, can be tied using a plurality of wires that have interlocking ends pre-formed into loops. In such a bale-tying operation, two workmen are normally (one on each side of the baling press) to manually bend the wires around the bale and to secure the ends of the wires together in a wire tie guide assembly. The wires are normally tied together sequentially, one at a time.

Since a plurality of wires are required to properly secure a cotton bale, e.g., a "universal density" cotton bale requires 8 wires, a manual-type bale-tying process can take a substantial amount of time. The amount of time it takes to tie a cotton bale is important since the process of pressing the next bale cannot begin until the preceding bale has been tied and removed from the press.

An automatic-type bale-tying apparatus is described in U.S. Pat. No. 4,484,510 to Jaenson, the disclosure of which is expressly incorporated herein by reference.

Jaenson discloses a hydraulically operated wire tying device for mounting on a baling press for tying a plurality of wires having pre-formed interlocking ends around a bale formed in a press. Pivotally mounted wire bend assemblies take the place of workmen on each side of the baling press for bending the tie wires around a bale and inserting the ends of the tie wires into a wire tie guide assembly.

A follow block, which is connected to and driven by the press ram below the bale, forms the floor of the baling chamber and includes a wire closer assembly. The wire bend assemblies pivot from a fully raised to a fully lowered position to bend the pre-formed interlocking ends of the wire around the bale and insert the interlocking ends into the wire closer assembly where the interlocking ends are joined together to form a knot.

Although an improvement over a manual-type bale-tying operation, Jaenson's hydraulically operated wire tying device still exhibits some problems which slow the ginning process. Exact timing is required for the sequence of events which makes up a wire tying operation. If a wire does not follow the correct path at the correct time, several factors can combine to prevent the interlocking ends of the wire from engaging in a knot. In particular, the interlocking ends of the wires are conventionally oriented such that the loops are disposed in a generally horizontal plane. This geometric orientation forces the wire closers to be constructed with relatively wide cavities, in order to accommodate the wide aspect ratios of the loops. This, in turn, allows the wires a greater degree of freedom of movement within the cavities.

Consequently, there is a greater probability of one wire merely sliding past another, without their loops engaging in a knot.

In addition, press wear, both alone or in combination with component manufacturing tolerances, can cause the follow block to vary its position or orientation both vertically or from side to side. Consequently, the wire bend assemblies may not be in alignment with the wire tie guide assemblies. All the above-described cases result in mis-ties, with a consequent loss of time and possible damage to the press.

Recently, the very nature of the cotton ginning process has been changed due to the introduction of a down-packer type baling press, in which the press ram is disposed above a box full of cotton and compresses the bale by moving downward against a stationary base plate. Down-packers have been developed in response to a peculiar environmental factor found in all cotton growing regions throughout the world; namely, a water table extremely close to ground level. In the past, cotton balers were of necessity constructed with their baling chambers at ground level for easy accessibility. Buildings constructed to house conventional up-packer baling presses would often require a cofferdam to be built into the ground surrounding a basement chamber which housed the hydraulics of the baling press ram. Such structures are very expensive to build.

The down-packer baling press disposes the press ram and the hydraulics for operating the ram in a mezzanine space above the baling chamber, which remains at approximately a workman's waist level on the ground level of a ginning house. The floor of the baling chamber is stationary and a bale is compressed by downward motion of the press ram against the stationary floor of the chamber.

However, because of the particular orientation of a down-packer press, it is not possible to adapt an automatic wire tier designed for an up-packer type press to the structure of the down-packer. In particular, in a manner well understood by those having skill in the art, the floor of a baling chamber is best described as a rectangular plate centrally mounted on a pivot post and which extends to either side in cantilever fashion and functions in the manner of a turntable. Raw cotton is packed into a pressing box placed on one side of the turntable-like structure and, when the box is full, the turntable (the base plate) is rotated 180 degrees into position over a base frame and underneath the press ram. The other side of the turntable (the base plate) is now exposed so that a second baling box may be packed with raw cotton while the first is being compressed.

Since wires need to be tied around the bale, the base plate must include guide tubes and slots through which wires may be inserted prior to tying. After insertion, the wires are required to be in a suitable position for engagement with an automatic wire-tying device. The geometry of previous up-packer wire-tying devices precludes their use on down-packer type presses. Simple inversion of their location would be impossible because of the construction and operation of the turntable-like down-packer press base plate.

Accordingly, an apparatus (and process) for tying bales formed in a down-packer type baling press, that is designed for efficient, error free operation is needed. Such an apparatus should be designed for easy operation by one workman to reduce labor costs, while at the same time being easy to install or retro fit to existing presses.

SUMMARY OF THE INVENTION

In accordance with this invention, a bale-tying device is provided for mounting on a down-packer type baling press.

The tying device can be operated by a single workman and is provided for tying a plurality of wires having pre-formed interlocking ends around a bale formed in the press. The tying device operates to tie the plurality of wires around the bale and then relax to a fully retracted position so that a baling press turntable may be rotated so as to position a next box of cotton beneath the press ram without interference by the structure of the wire-tying device. After a new cotton box is positioned beneath the press ram, the wire-tying device is raised to a partially extended loading position for easy loading by a single workman. Subsequently, the wire-tying device is automatically operable to tie the plurality of wires around the bale after the press ram has been fully lowered. Thus, in accordance with the invention, the pressing operation and the tying operation proceed sequentially, but within a substantially brief period of time.

The tying device comprises a first wire bend assembly pivotally mounted on one side of the baling press for holding and bending the first pre-formed interlocking end of a wire upwardly. A second wire bend assembly is pivotally mounted on the opposite side of the baling press for holding and bending the second pre-formed interlocking end of the wire upwardly around the opposite side of the bale.

In one aspect of the invention, the wire tying device additionally comprises a movable follow block and which moves against the bale in order to compress the bale in the chamber, and a wire closer in which the first interlocking end of the wire is held by the first wire bend assembly as the second interlocking end of the wire is moved by the second wire bend assembly into interlocking engagement with the first end. Guide means are also provided for guiding the first interlocking end of the wire into a proper position in the wire closer and for guiding the second interlocking end of the wire into interlocking engagement with the first end to thereby form a knot.

In another aspect of the invention, the wire closer comprises an elongated, open-ended cavity extending across the width of the closer, the first pre-formed interlocking end of the wire is inserted into the first open end of the cavity by the first wire bend assembly as the first assembly is pivoted upwardly, and the second interlocking end of the wire is inserted into a second open end of the cavity by the second wire bend assembly as the second assembly is pivoted upwardly.

Each of the wire closers comprises a cavity open on both ends for insertion of the opposite ends of the wires, each of the wire closers further comprising means for holding the first interlocking end of such a wire in proper position so that when the second pre-formed interlocking end of such a wire is inserted into the wire closer, the interlocking ends are joined together in a knot.

In yet another aspect of the invention, each wire bend assembly comprises an articulated lever assembly including a pivotally movable shaft at the distal end and an arm assembly mounted on the shaft incapable of being pivoted upwardly from a fully retracted to a fully extended position and which includes a finger assembly mounted on the arm assembly, which comprises a plurality of horizontally spaced-apart fingers each of which can be pivoted upwardly from a fully retracted to a fully extended position. Each such finger on the first wire bend assembly is associated with a counter part finger on the second wire bend assembly. The wire bend assembly is constructed so that when both the arm assemblies and the fingers comprising the first and second wire bend assemblies are in their fully extended positions, and the wires to be tied around the bale are positioned in the tying device for tying, each such wire is held on one end by one of the fingers of the first wire bend assembly and extends across the baling press such that the second end of such wire is engaged by the counterpart finger of the second wire bend assembly.

Each finger assembly further comprises guide means for guiding the first interlocking end of the wire into position in the wire closer cavity and for guiding the second interlocking end of the wire into interlocking engagement with the first end. In particular, the guide means comprises a cam arm assembly coupled to the finger assembly which controls the angular position of the finger assembly with respect to the follow block. The cam arm assembly includes a cam roller for engaging the wire closer assembly, the cam roller entering a corresponding cavity in the wire closer assembly thereby guiding the finger assembly fingers into the open ends of their corresponding cavities.

BRIEF DESCRIPTION OF THE DRAWINGS

These and other features, aspects and advantages of the present invention will be more fully understood when considered with respect to the following detailed description, appended claims, and accompanying drawings, wherein:

DETAILED DESCRIPTION

Figure 1:
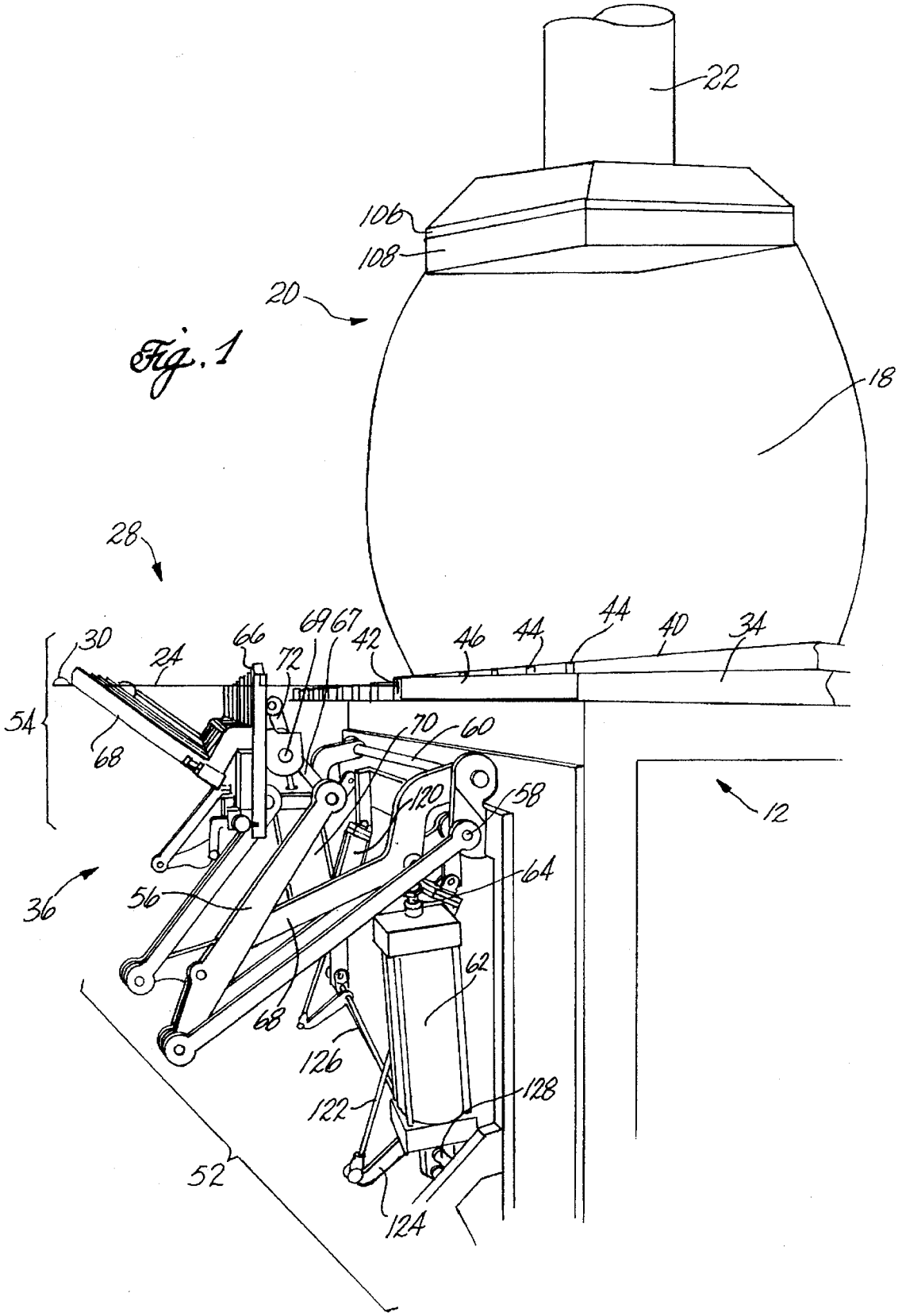
FIG. 1 is a semi-schematic, enlarged perspective, fragmentary view of an exemplary embodiment of a wire-tying device provided in accordance with practice of principles of the invention which is mounted on a baling press for tying a plurality of wires around a bale formed in the press.

Referring now to FIG. 1, there is shown a semi-schematic perspective view of the front, or operator, side of a working embodiment of a wire-tying device 10, provided in accordance with this invention, mounted on a down-packer type cotton baling press 12. For clarity of illustration, the press 12 is shown in simplified view and with the front and back doors, typically provided on the baling chamber of such presses, omitted for the sake of illustrational clarity. The press 12 is depicted in an open condition so as to provide access for tying a bale 18 compressed in the baling chamber 20 by means of a downwardly moving press ram 22.

As is described below in greater detail, the tying device 10 (which is shown in FIG. 1 in a partially extended, loading, position) is useful for tying a plurality of wires 24 around a bale, such as the bale 18, after the bale has been formed in the baling chamber 20. If desired, the device 10, provided in accordance with this invention can be adapted to tie any number of wires around the outside surface of the bale, but preferably is adapted to tie 8 wires. In addition, although the tying device 10 is described with particular reference to a cotton baling operation, it can be adapted for tying bales of other suitable materials as well.

A key feature of the tying device 10, provided in accordance with this invention, is that it is designed to be loaded with tie wires and operated from the front side of the press by a single workman. Since only one workman is required, and that workman need not travel back and forth from the front to the back of the press, the bale-tying operation performed by the tying device 10 is economical. For purposes of exposition herein, the front side of the tying device (shown in FIG. 1) is termed the "operator side", or alternatively the "load side", and the back side is termed the "unattended side".

An additional feature of the tying device 10 provided in accordance with this invention, is that it is designed to be affixed to, and used in combination with, a down-packer type cotton baling press. As will be described in greater detail below, particular features of the wire-tying device 10 allows for automatic tying of a plurality of wires around a cotton bale, without the devices interfering with the normal motion of the down-packer presses turntable base plate.

The tying device 10 comprises two separate assemblies which operate together to automatically tie the plurality of wires around the bale 18. A first, upper assembly suitably comprises a follow block structure 26 which, as described below in greater detail, is uniquely constructed in accordance with this invention, and which rides above the bale on the press ram head 22*a*. A second, lower assembly 28 is mounted on the baling press below the baling chamber 20 and is provided for bending the plurality of wires 24 around the exterior of the bale and for inserting the opposed ends of the wires into the follow block 26 where they are joined together to form a knot.

Figures 2, 15:
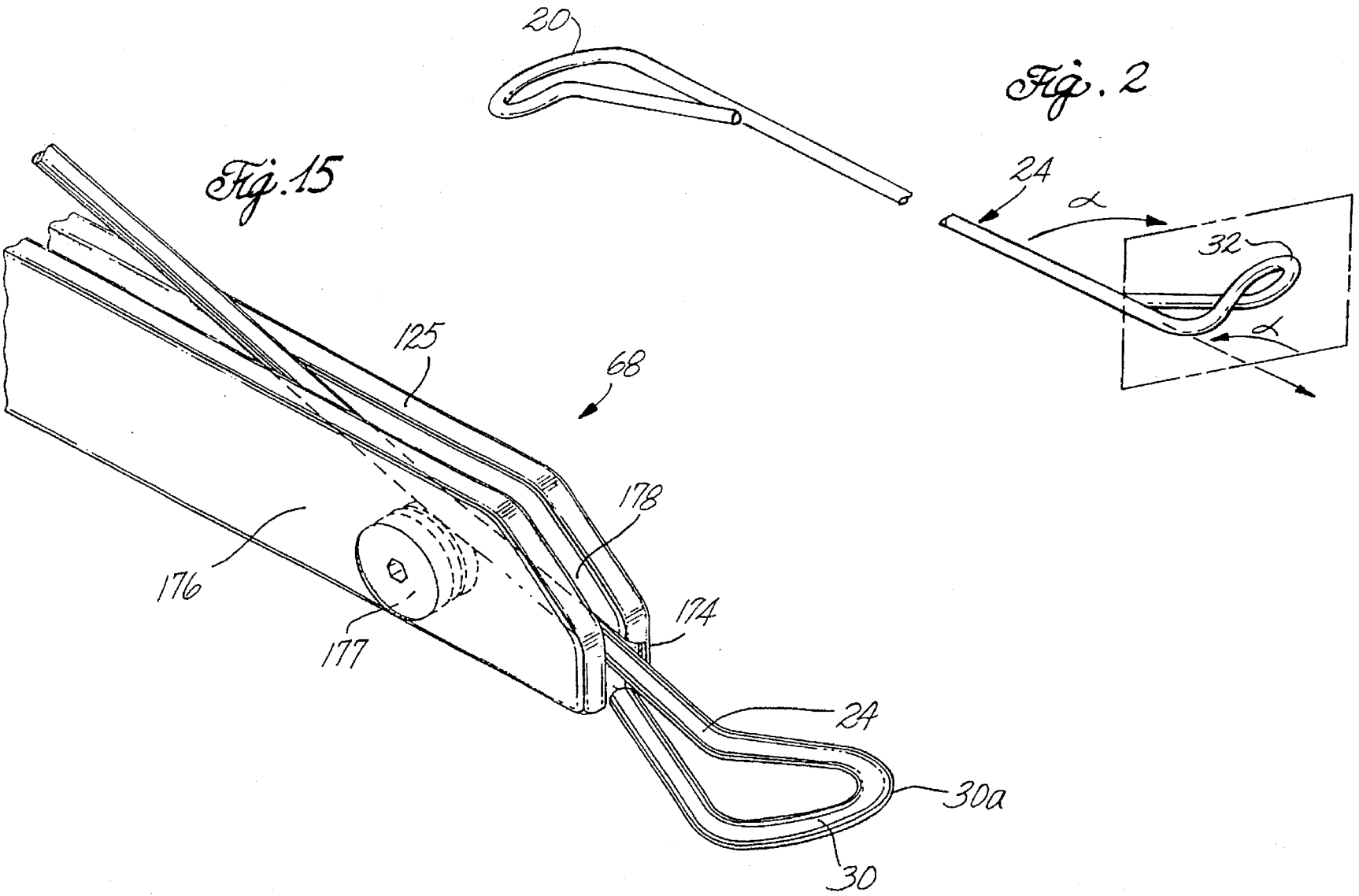
FIG. 2 is a fragmentary perspective view of a wire having first and second interlocking ends formed into loops that can be used by the wire-tying device of the invention for tying around the bale.
FIG. 15 is an enlarged, semi-schematic, fragmentary perspective view of one of the fingers on the operator side of the wire-tying device with a wire engaged in the finger.

Referring to FIG. 2, it will be understood by those skilled in the art, that each of the wires 24 to be tied around the exterior of a bale 18 has a first pre-formed interlocking end or loop 30, disposed on the operator, or load, side of the tying device (shown in FIG. 1) and a second pre-formed interlocking end or loop 32, disposed on the unattended side of the tying device. As will be described in greater detail below, the first and second interlocking ends 30 and 32 each of the wires 24 are automatically engaged together to thereby form a knot in the follow block 26 by the action of the lower assembly 28 on the wires. Additional details of wires useful in practice of principles of the invention, and the manner in which the interlocking ends of such wires engage one another to thereby form a knot, may be found in the aforementioned U.S. Pat. No. 3,477,363 to Trumbo.

As can be seen from inspection of FIG. 2, the ends of the wires 24 are bent into oblong, generally elliptical loops 30 and 32 which define a plane. As will be described further below, when the wires 24 have been loaded into the tying device, in preparation for being tied around a bale, the wires are oriented such that the plane of the loops 30 and 32 are substantially vertical. Moreover, it will be noted from FIG. 2, that the vertical plane of each loop is bent, or deflected, away from the major axis of the wire, such that the wire axis and the plane of each loop forms an obtuse angle, indicated in FIG. 2 as $\alpha$.

Figure 5:
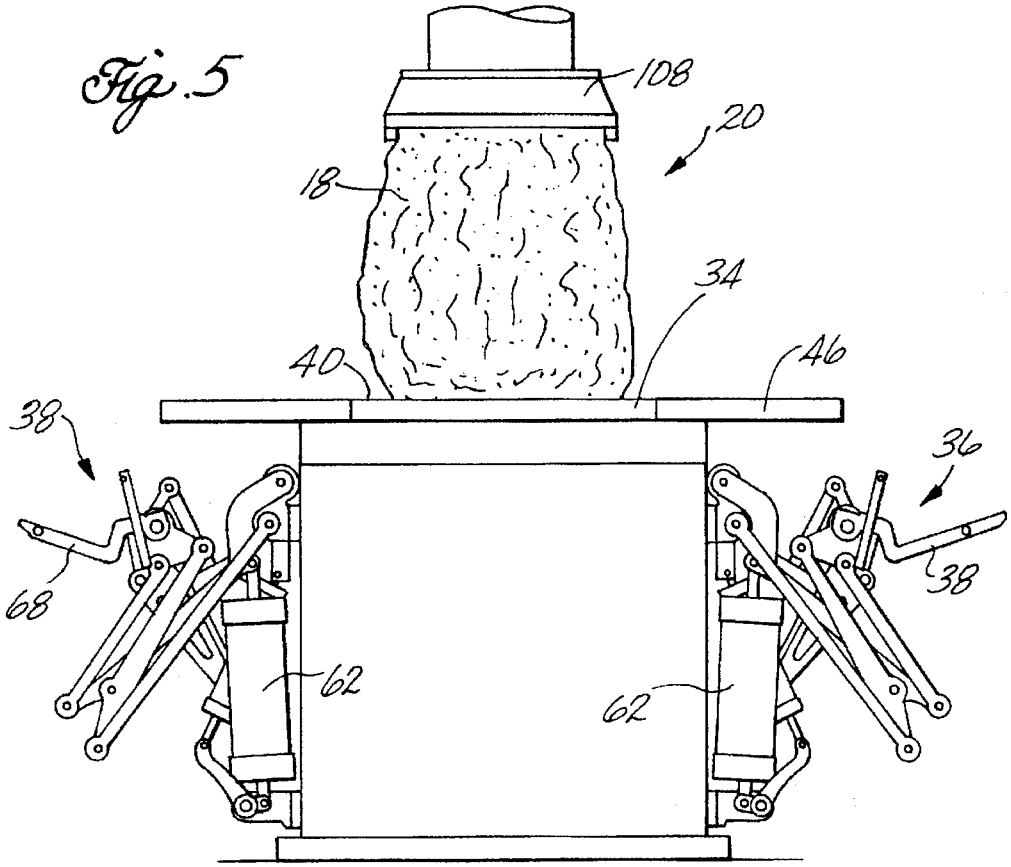
FIG. 5 is a semi-schematic, fragmentary end view of an exemplary embodiment of a wire-tying device provided in accordance with the invention mounted on a down-packer type baling press showing the tying device in its fully retracted position.

Referring now to FIG. 5, in addition to FIGS. 1 and 2, it can be understood that the tying device lower assembly 28 comprises three separate structures that are operably connected together; a base plate 34 forming the floor of the baling chamber and comprising that portion of the down-packer press turntable which has been rotated into such position (to thereby form the floor of the baling press), and a pair of wire bend assemblies 36 and 38 (best seen in FIG. 5) are mounted on the baling press to opposite sides of the base plate 34 for upward and downward pivoting action. The first wire bend assembly 36 is mounted on the operator, or load, side of the press (shown in FIG. 1), and the second wire bend assembly 38 is mounted in similar fashion on the unattended side of the press.

The top surface 40 of the base plate 34 forms the floor of the baling chamber 20 and provides one of the surfaces against which the bale 18 is compressed. Returning to the illustrated embodiment of FIG. 1, it can be understood that the base plate 34 suitably comprises 8 elongated, slotted channels 42 formed in its upper surface 40. The channels 42 are open ended and extend from the front side to the back side of the base plate 34 across its width. The wires 24, when loaded on the tying device 10, extend through the channels 42 and exit the channels through the channel slot 44 during the bale-tying operation so that the completed bale can be removed from the press.

A plurality of horizontally spaced-apart guide tubes 46 are formed integral with the base plate 34 and extend beyond the edges of the base plate on the front and back sides. The guide tubes 46 are preferably hollow and include, on their top surfaces, an extension of the slots 44 provided in the top surface 40 of the base plate 34. The guide tubes 46, thus form extensions to the channels 42 in the base plate, which channels extend in a horizontal plane towards the front and back sides of the press, beyond the confines of the base plate.

As will be described in greater detail below, the channels 42 and guide tubes 46 guide the wires 24 through the base plate 34 into a proper position for loading the wire tying device 10, and support the wires horizontally during the initial stages of the loading process.

As can be best seen by referring to FIG. 1, the first wire bend assembly 36 and, likewise the second wire bend assembly 38 disposed on the backside of the press, comprise two separate structures that are operably joined together; an articulated, wire positioning assembly 52 pivotally mounted on the side of the press below the base plate 34, and a finger assembly 54 rotationally journaled to the end of the wire positioning assembly 52. The construction of the positioning assemblies 52, and the connection between the positioning assemblies and their associated finger assemblies can be readily understood with reference to the illustrated embodiment of FIG. 1.

Each positioning assembly 52 includes a pair of horizontally spaced-apart articulated, extending lever arm assemblies 56, positioned at the left hand and right hand sides of the tying device, when viewed by an operator standing in the operator position. Each articulated lever arm assembly 56 is rotatably affixed to the frame of the baling press and, in operation is pivoted about through-bolt bushings 58 in combination with a pivot shaft 60. Each positioning assembly 52 further comprises a pair of horizontally spaced-apart hydraulic cylinders 62, each mounted in a vertical orientation and below respective ones of the articulated extending lever arm assemblies 56. Extended from the top of each hydraulic cylinder 62 is a push rod 64 connected, in turn, to a central lever arm 68 of its associated articulated lever arm assembly, in an off-center position towards the press along the central lever arm.

Figure 3:
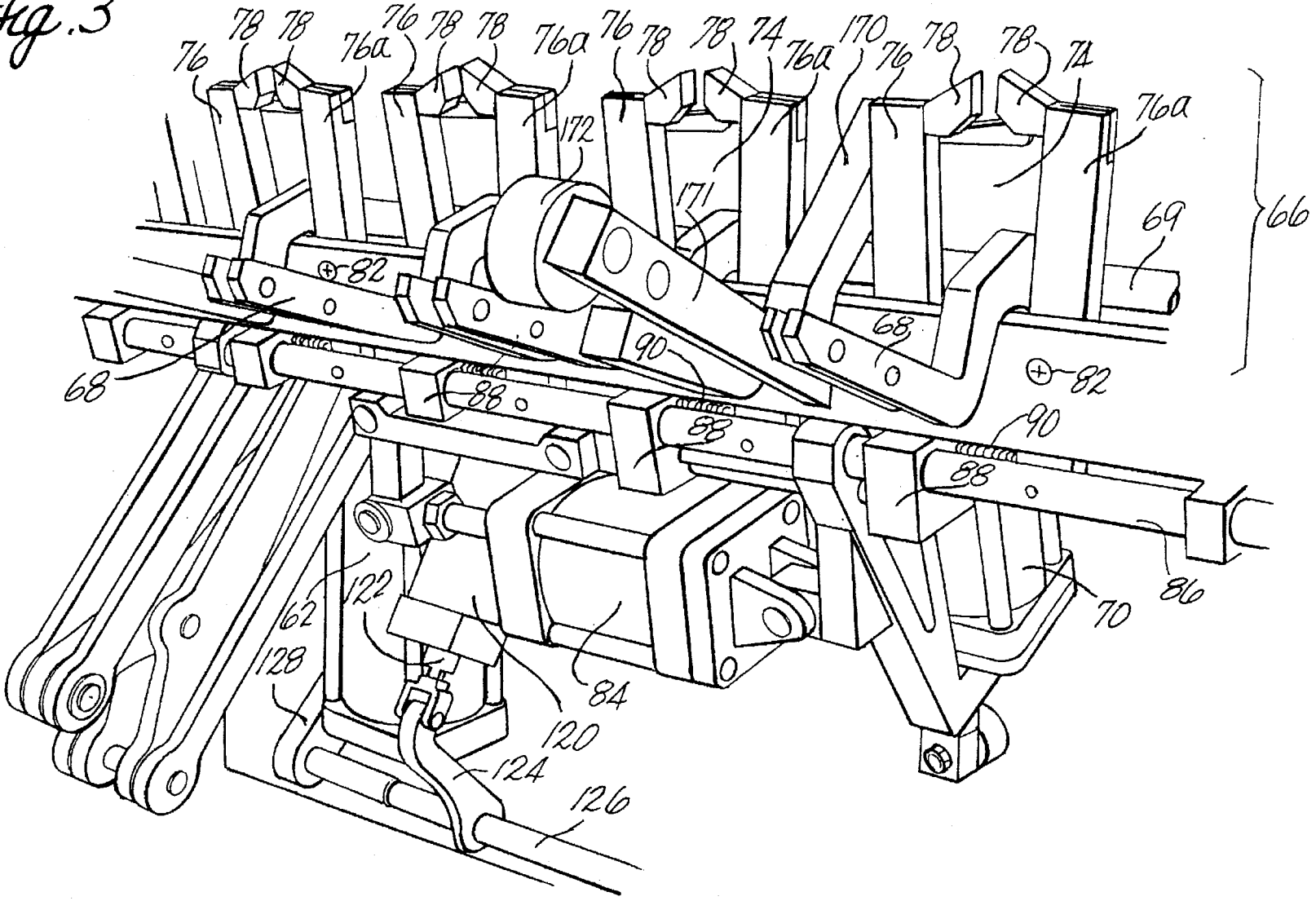
FIG. 3 is a semi-schematic, enlarged perspective, fragmentary view showing details of the gripper assemblies that comprise one of the wire bend assemblies of the tying device of FIG. 6.

Referring more particularly to FIG. 3, it will be understood that each finger assembly 54 further comprises a gripper structure 66 connected to each of the articulated extending arm assemblies 56 by shafts 67 to which the distal ends of the articulated arms are journaled. In addition to the gripper structure 66, each such finger assembly 54 includes 8 elongated fingers 68 (only 4 of which are shown in FIG. 3) horizontally spaced-apart from each other and rotatably mounted on a horizontal rod 69 (best seen in FIG. 1). A pneumatic cylinder 70 is provided on each finger assembly and is connected to the rod 69 by means of a crank 72 (best seen in FIG. 1). As is described in greater detail below, when the pneumatic cylinder 70 is operated, the distal ends of the fingers 68 are pivoted upwardly from their retracted position, which extends downward and generally horizontally away from the press (as shown in FIG. 5), to their fully raised position (best shown in FIG. 8).

It will be understood that the operator side finger assembly comprises 8 fingers 68, while the unattended side finger assembly likewise comprises 8 fingers. Each of the fingers 68 on the finger assembly 54 on the operator's side, is directly across from a counter part finger on the finger assembly on the unattended side. As is described in greater detail below, each finger 68, and its counter part finger, i.e., each pair of fingers, operates on the opposed ends of a single wire during the tying operation.

Referring again to FIG. 3, the above-described finger assembly 54 further comprises a cam arm assembly 170 which is connected to the rotatedly mounted horizontal rod. The cam arm assembly 170 is connected to the horizontal rod 69 in approximately the center of the rod at a position approximately mid way between two bracketing fingers, and is connected to the horizontal rods 69 such that when the pneumatic cylinder 70 is operated the cam arm assembly 70 is pivoted upwardly, along with the fingers 68, from a generally horizontal relaxed position, to a fully raised position (best shown in FIG. 8).

The cam arm assembly 170 further comprises a cam arm 171, connected to the rod 69 at a proximal end, and a cam roller 172 connected to the distal end of the cam arm, i.e., at the end opposite the horizontal rod 69. Cam roller 172 is connected to the cam arm 171 in a manner which allows the roller to be free to rotate about its attachment axis on the cam arm 171. As will be described in greater detail below, the cam arm assembly 170 functions to guide the finger 68 of the finger assemblies 54 into a correct engagement position inside the follow block structure 26 after a bale has been compressed.

Details of the construction operation of the gripper structure 66, provided on both the first and second wire bend assemblies 36 and 38, respectively, can be best understood by referring to FIGS. 1 and 3. Each gripper structure 66 comprises 8 identical anvil assemblies 74 horizontally spaced-apart from each other. One such anvil assembly 74 is associated with a corresponding one of the fingers 68 and functions to hold one end of each wire 24 firmly therein during the wire-bending operation. As is best seen in FIG. 3, each anvil assembly 74 comprises a pair of vertically extending anvil arms 76 and a pair of opposed anvil blocks 78 mounted at the distal ends of the anvil arm 76. The anvil blocks extend towards one another, each from the inside edge of its associated anvil arm 76 so as to present opposed faces to one another between which a wire may be gripped. One anvil arm **76*a* of each anvil arm pair is pivotally mounted on the gripper structure by means of a pivot bearing 82 so that each such arm can be pivoted toward and away from its associated anvil arm so as to close the opposed faces of their associated anvil blocks 78. A pneumatic cylinder 84 (shown in FIG. 3) is mounted on the gripper structure 66 of both finger assemblies for providing the pivoting motion to each of the pivotable anvil arms. The pneumatic cylinder 84 is operably connected to a shaft 86 that extends horizontally along the length of the gripper structure. Fixedly connected to the shaft 86 in a horizontally spaced-apart relationship are 8 stop blocks 88, each of which bears against the bottom of the pivotally movable one 76*a* of the pair of anvil arms 76. Extending between each arm of the anvil arm pair is a spring assembly 90 (not shown in FIG. 3**).

When the pneumatic cylinders 84 on both the front and back side gripper structure 66 are operated to open the anvil assemblies, i.e., when the cylinders are operated to pivot the bottom portion of the rotatably mounted anvil arm **76*a* towards its mate in the anvil arm pair. Such movement of the rod 86 pushes the stop blocks 88 against the bottom of the anvil arm 76*a* to thereby pivot the bottom of the anvil arm towards its associated pair number to thereby move the opposed faces of the anvil blocks 78 away from one another. (The anvil assembly is depicted in its open position in FIG. 3**)

When it is desired to close the anvil assemblies, the pneumatic cylinders 84 are operated to move the shaft 86 horizontally to the left (in the perspective of FIG. 3). Such movement of the shaft 86 moves the stop blocks 88 away from the bottom of the rotatably mounted anvil arms **76*a*, thereby allowing the spring assemblies, interposed between the bottoms of each anvil arm pair, to release, thus providing a spring force which pivots the rotatably mounted anvil arm 76 about their pivots 82 and thereby closing the opposed faces of the anvil blocks 78. The spring assemblies 90 provide sufficient force to hold the anvil assemblies closed so that the wires 24, positioned within the anvil assemblies, are held firmly in place between the opposed faces of the anvil blocks 78 since each anvil arm pair is independently held closed by an associated spring assembly 90, wires that have different diameters, e.g., due to wire manufacturing tolerances, can be accommodated at the same time on the tying device 10 of this invention. If the anvil arms were solidly mounted on the shaft 86**, for example, only the wire with largest diameter would be able to be grasped firmly in the closed anvil assembly, while wires of a smaller diameter would be loose.

Referring now to FIGS. 1 and 3, a positioning assembly is mounted on each wire bend assembly 36 and 38, and which is provided to partially extend the arm assemblies such that each finger assembly 54 is moved upwardly from a first, fully retracted position below the horizontal plane of the base plate 34, to a second, partially extended wire load position as depicted in FIG. 1.

The positioning assembly suitably comprises a pneumatic or hydraulic cylinder 120 that is connected by means of a cylindrical rod 122 and associated linkage 124 to a horizontally extending torque rod or bar 126. The torque rod or bar 126 terminates, at either end in a cam 128 which is, in turn, connected to the bottom surface of each of the pneumatic cylinders 62 which operate the arm assemblies 52. Operation of the cylinder 120 is translated by the linkage 124 to the torque rod 126, which rotates the torque rod, thereby causing the cam 128 to engage the bottom surface of pneumatic cylinders 62, forcing the cylinders upward in response to pressure from the cam. This upward motion of the cylinders 62 is translated by the structure of the cylinders to the central lever arm 68 of the articulated arm assemblies 56. Motion of the articulated arm assemblies 56 moves the finger assemblies 54 in an upward direction to a sufficient degree that the distal ends of the fingers 68 and the open faces of the associated anvil blocks 78 are generally aligned in a horizontal plane which is, in turn, defined by the plane of the base plate 34 and its associated guide tubes 46.

The operation of the positioning assembly can be adjusted to provide a desired amount of lift, or extension, to the finger assemblies. In a working environment, the positioning assembly can be adjusted so that after wires are threaded through the guide tubes 46 they are disposed, horizontally, in a manner which allows them to rest, naturally, between the open faces of an anvil block pair and drape within a convenient distance from the tips of the fingers 68.

Means are provided, in accordance with the practice of the invention, for guiding the wires 24 into proper position in the tying device 10 during the wire-loading operation. The wire guide means comprise a guide tube assembly 46 which extends from and lies in a horizontal plane defined by the base plate 34 of the baling press. FIG. 1 depicts the guide tube assembly 46 on the operator's side of the press. Likewise, an identical guide tube assembly is disposed on the opposite, unattended, side of the press. The construction of both the guide tube assembly 46 on the operator's side and the guide tube assembly on the unattended side of the press can be understood by referring to FIG. 1. Each of the guide tube assemblies comprises 8 interconnected, horizontally, spaced-apart hollow guide tubes, wherein each such guide tube is open at both ends and forms a horizontal extension of the channels 42 through the base plate. Each guide tube is associated with one of the fingers 68 on its respective wire bend assembly. Additionally, each guide tube is aligned in a direction parallel to its associated finger 68 when the finger is in its partially extended load position. A slot 44 is provided through the top of each guide tube along its length so that the wires 24 insert through the guide tubes can exit the tubes during the tying operation. Additional details of the construction of the guide tubes and their operation will be described below with regard to the operation of the wire-tying device.

Figure 4:
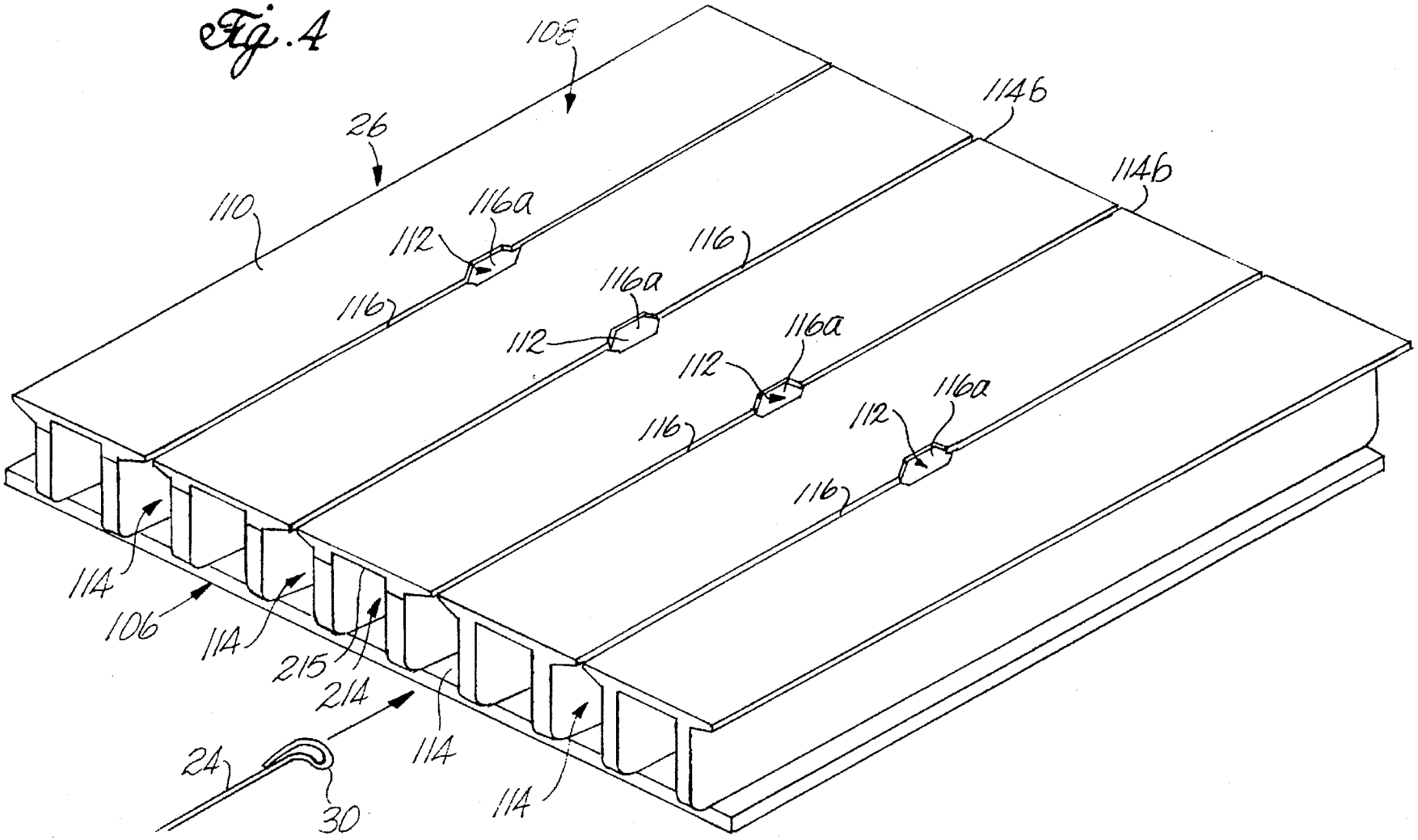
FIG. 4 is an enlarged, fragmentary perspective view of the follow block of the wire-tying device in accord with the invention.

Referring now to FIGS. 1 and 4, the follow block structure will now be described with reference to an illustrated embodiment. FIG. 4 depicts an enlarged, fragmentary perspective view of the follow block 26 of the wire tying device 10 of FIG. 1. For purposes of illustration clarity and simplicity of explanation, the follow block is depicted in FIG. 4 upside-down. In other words, the upper surface of the illustration of FIG. 4 is the bottom surface of the follow block as it would be mounted on a down-packer press ram.

In FIGS. 1 and 4, the follow block structure 26 comprises a base 106 and a wire closer assembly 108 mounted on the base. The top surface 110 (as illustrated) of the wire closer assembly 108 forms the ceiling of the baling chamber 20 in which a bale 18 is formed. The bale 18 rests on the base plate 34 and is compressed against the wire closer surface 110 when the press ram 22 is lowered. The closer assembly 108 comprises a plurality of horizontally spaced-apart, identical wire closer structures or closers 112. In this instance, since the wire-tying device 10 of the illustrated embodiment is designed to tie 8 wires around the bale, 8 wire closers 112 make up the closer assembly 108 (4 such wire closers 112 are shown in FIG. 4). Each wire closer 112 includes a cavity 114 open at both ends for insertion of the opposed pre-formed interlocking ends 30 and 32 of one of the wires as such a wire is bent around the bale by the operation of the wire bend assemblies 36 and 38. For example, as best seen in FIG. 4, the first pre-formed end 30 of each wire is inserted into a first, open end **114*a* of the wire closer cavity 114, and of the second pre-formed end 32 of each wire 24 is inserted into the opposite open end 114*b* of the cavity 114**. Means described below in greater detail are provided in each wire closer cavity for joining the pre-formed interlocking ends of the wires together as such opposed ends are inserted into the cavity and moved into engagement with one another to thereby form a knot.

A slot 116 extends horizontally across the surface 110 of each wire closer 112 and opens, along its length, into its associated cavity 114. The slots 116 are provided for allowing removal of the wires 24 after the wires are tied around the bale. An enlarged area **116*a* provided about mid way along the length of a slot 116, is provided to allow removal of the knot formed by the interlocking ends of the wires after they are joined together. In addition to the wire closer cavities 114, a guide cavity 214 is provided in approximately the center of the follow block structure, sandwiched between two wire closer cavities. The guide cavity 214 is open at both ends for insertion of the opposed cam arm assemblies 170 (best seen in FIG. 3) as the wire bend assemblies 36 and 38 are bent around the bale. As will be described in greater detail below, the bottom interior surface of the guide cavity 214 is constructed with a leading edge bevel 215 which engages the cam roller 172 as the cam arm assembly 170 begins the insertion process into the open end of the guide cavity 214**.

Additional interior details of construction of the wire closers 112 are described below in relation to the operation of the wire-tying device.

Load and Automatic Tying Operation

Loading of the wires 24 onto the wire-tying device 10 in the operation of the device for automatically tying the wires around the bale 18 can be understood by referring particularly to FIGS. 5 through 9.

Referring first to FIG. 5, the wire tying device 10 is initially in a pre-load state in which the arm and finger assemblies on either side of the press are in a fully retracted position, below the horizontal plane of the press ram base plate. After the cotton is positioned beneath the press ram, and the turntable motion of the base plate has ceased, the wire-tying device is now ready for loading.

Figure 6:
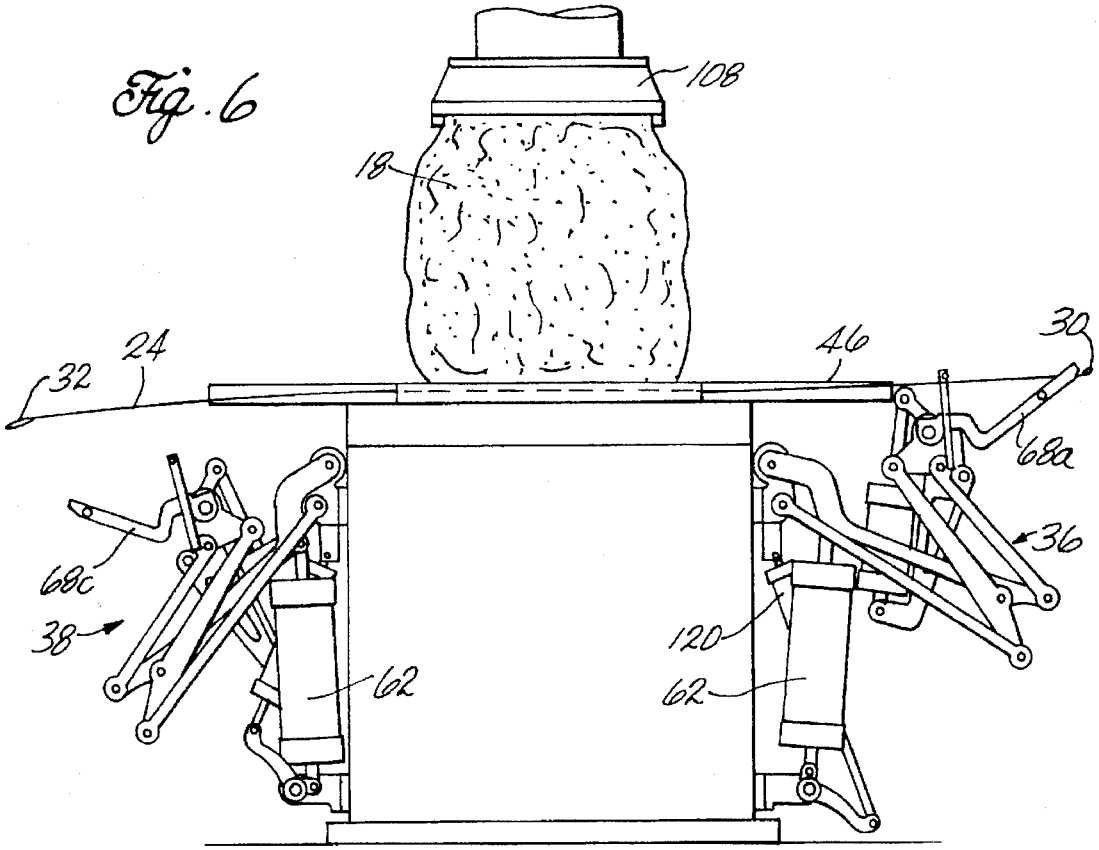
FIG. 6 is a semi-schematic, fragmentary end view of the tying device of FIG. 5 at a first stage in the wire-tying operation showing the tying device being loaded and with the wire bend assembly fingers of the load side being raised to the load position.

Referring now to FIG. 6, the wires 24 are loaded or positioned in the device 10 for tying by a single workman stationed on the front, or operator, side of the press. To load each such wire 24 into the device 10, the workman pushes the second pre-formed end 32 of the wire through one of the guide cavities of the guide assembly provided through the base plate 34 which forms the bottom of the baling chamber. This procedure is repeated for loading all eight wires 24 into the device. At this time, the first pre-formed end 30 of each wire 24 (shown in dashed lines in FIG. 6) extends out from the guide tubes 46 to a position where the operator is able to engage the first pre-formed end 30 in its associated operator side finger 68*a* and between the now open anvil blocks of the anvil assembly in which it is to be held. In similar fashion, the second pre-formed end 32 of each wire 24 (as shown in dashed lines in FIG. 6) extends from the opposite end of the opposite end of the guide tube 46 to a position above its associated finger 68*b*.

Referring now to FIG. 15, in addition to FIG. 6, the operator places the first ends 30 of each of the wires 24 in a notch 174 in the end of each of the fingers 68. As is shown more clearly in FIG. 15, each finger 68 is constructed from two metal cheek plates 175 and 176 which are spaced-apart by a spacer assembly 177 in order to from a slot 178, between the two cheek plates, into which the shaft of the wire 24 is disposed. The slot 178 is provided so that the pre-formed end 30 of each wire 24 can slide along the slot, over the spacer assembly 177, and project out of the end of the finger as the wire is bent during the tying operation.

A notch 174 is cut into one of the cheek plates in its distal end, i.e., the notch 174 is on the end of the finger 68*a*. The slot 178, defined by the cheek plates 175 and 176, is constructed with a cross-sectionally tall aspect ratio such that the slot 178 is substantially deeper than it is wide. The slot 178 has sufficient width, defined by the spacer assembly 177 to hold a wire therein, but because the loop diameter is greater than the width of the slot 178, the loop may only be inserted in the slot 178 when the loop in the wire first end 30 is oriented in a vertical plane. The slot width is sufficiently narrow to prevent the wire 24 from rotating once the loop in the first end 30 is positioned between the plates 175 and 176. Since the first end loop 30 of the wire 24 is disposed in a plane oriented at an obtuse angle with respect to the major axis of the wire, the loop bears against that plate 175 towards which the plane of the loop end is directed. Once the loop is positioned within the slot, and oriented vertically, the first end 30 is snapped into the notch 174 which engages the first end 30 and holds the wire in place.

As is described below in greater detail, the ends 30 of the wire must extend a sufficient distance from the distal ends of the fingers 68 so that the wires can be properly positioned and joined together in the wire closers. Since the wires 24 are placed in proper position by their insertion into the notch 174 in the distal end of the finger on the operator side, no such notch is required, and none is provided, on the fingers of the bend assembly on the back, or unattended, side of the press. By the operation of moving the wires 24 into the slot 178 and engaging the ends 30 of the wire into the notch 174, the wire is necessarily positioned between the open jaws of each gripper assembly on the operator's side of the press.

To position the opposite ends of the wires 24 in their associated fingers and open gripper assemblies on the unattended side of the press, the workman, for example, pushes a button on a control circuit panel, to thereby operate the load hydraulic cylinder 120 on the unattended side of the press. Such a mode operation of the cylinder 120 lifts the arm and finger assemblies of the unattended side of the press from a first fully retracted position (best shown in FIG. 6) to a second relatively higher loading position (shown in FIG. 7).

The fingers on the unattended side of the press are constructed in a manner similar to the embodiment illustrated in FIG. 15. However, the cheeks of the tips of the fingers on the unattended side of the press are flared open, to form thereby a V-shape. As the arm and finger assemblies of the unattended side of the press are raised to their loading position, the V-shaped tips of the fingers engage the wires projecting from the guide tubes on the unattended side. The wires will slide along the V-shaped wall surface of the finger tips and be thereby positioned in the center of the slot. Orienting the wires in this manner positions them properly between the opposed faces of the associated anvil blocks comprising the anvil assembly on the unattended side of the press.

About 1 second after the arm and finger assembly of the unattended side is raised to the load position and thus, after all the wires 24 are properly positioned in the open gripper assemblies, the control circuit automatically operates the pneumatic gripper structure cylinders (84 of FIG. 3) on both the load and unattended side of the press. Operation of the cylinders 84 closes the anvil assemblies in the manner described above so that the wires are now held securely in place for bending and subsequent tying.

After the above-described manual and semi-automatic wire loading operations have been completed, and the wires are secured in the anvil assemblies, the tying device is said to be in its "fully loaded" condition. As is described below in greater detail, once the tying device is in its fully loaded condition, the remainder of the bale tying operation proceeds in accord with an automatic sequence under control of, for example, a conventional sequential control circuit.

After the tying device is loaded, and when the press ram 22 reaches a pre-determined position, the press doors are opened so that the bale 18 is exposed in the baling chamber for tying. The press doors, when fully opened, may operate a limit switch in a control circuit which, in turn, starts the automatic sequencing of the bale-tying operation. Alternatively, the press doors may be automatically opened and the automatic sequencing of the bale-tying operation may be started when the press ram reaches a pre-determined position which, in turn, operates a limit switch in a control circuit.

Figure 7:
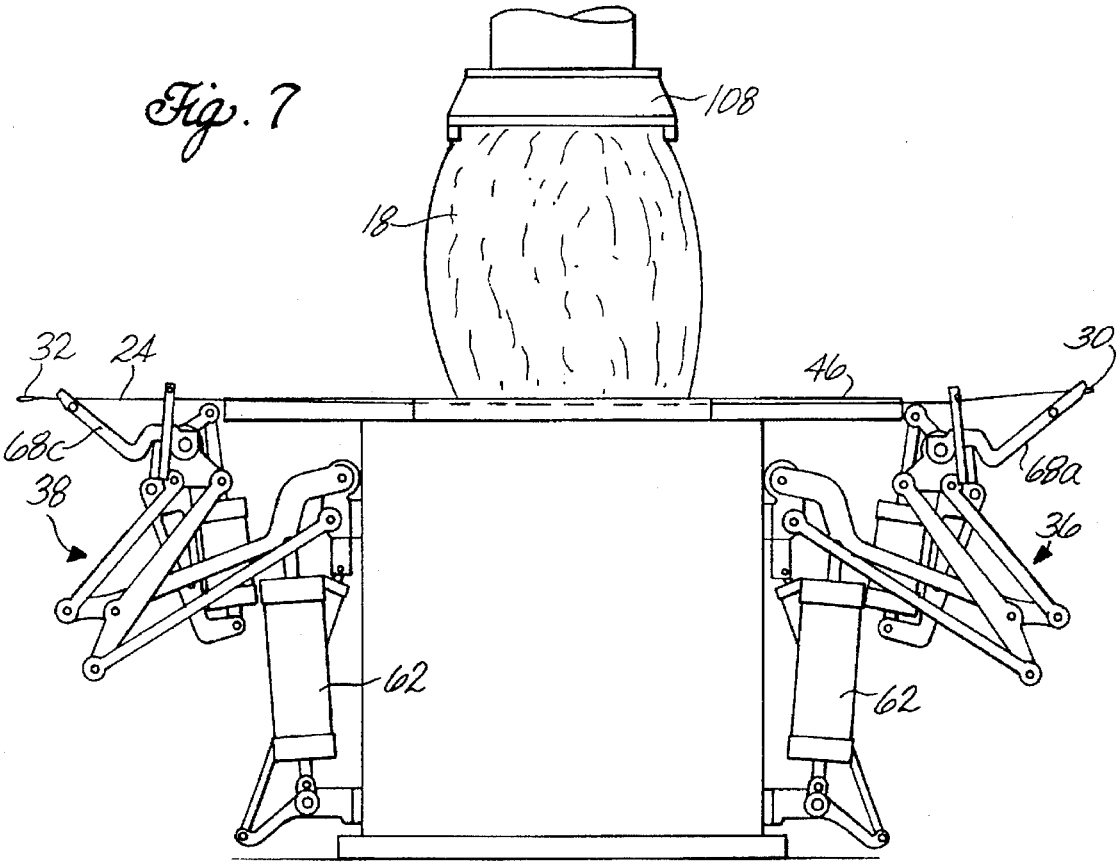
FIG. 7 is a semi-schematic, fragmentary end view of the tying device of FIG. 6 at a second stage in the wire-tying operation after both wire bend assembly fingers have been raised to the loaded position.
Figure 8:
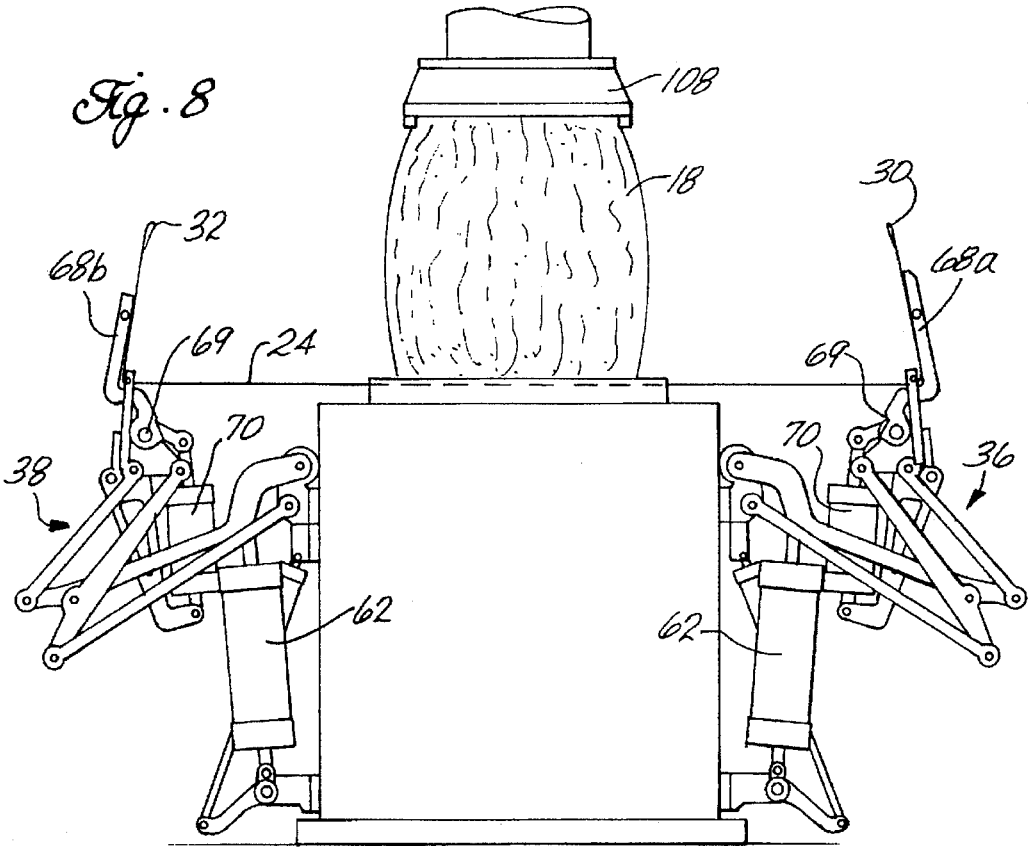
FIG. 8 is a semi-schematic, fragmentary end view of the wire-tying device of FIG. 7 at a third stage in the wire-tying operation with the wire bend assembly fingers in their fully rotated position.

Referring now to FIG. 8, the control circuit automatically initiates the tying sequence by first operating pneumatic cylinder 70 on both the first and second wire bend assemblies 36 and 38, to thereby rotate the rod 69 associated with the finger assemblies 54 by about 90°. Rotation of the rod 69 pivots the fingers 68 on the first finger assembly 54 and the fingers on the second finger assembly from their fully lowered position (as shown in FIG. 7) to their fully raised position (as shown in FIG. 8). Such pivoting movement of the fingers bends the ends of each of the wires 24 by about 90° around the point where they bear against the closed anvil assemblies in which they are held.

As best seen in FIG. 4, since the pivot point of the fingers, i.e., the rotational axis of the rods 69, are farther from the ends of each of the wires 24 than are the bearing points of the gripper assemblies around which the wires are bent, the first pre-formed ends 30 of the wires slide out of the ends of the fingers 68 as the wires are bent by the fingers. In a working embodiment of the wire-tying device 10, the first pre-formed ends 30 of each of the wires 24 extend about 4 inches out of the front of the fingers 68*a* after the approximately 90° bend is made. The second pre-formed ends 32 of the wires 24 also slide away from the tips of the finger 68*b* to approximately the same degree. Therefor, after the fingers have been pivoted from their fully lowered to their fully raised positions, the wire ends 30 and 32 are a desired distance from the tips of their associated fingers so that they may be properly positioned in the wire closers.

Figure 9:
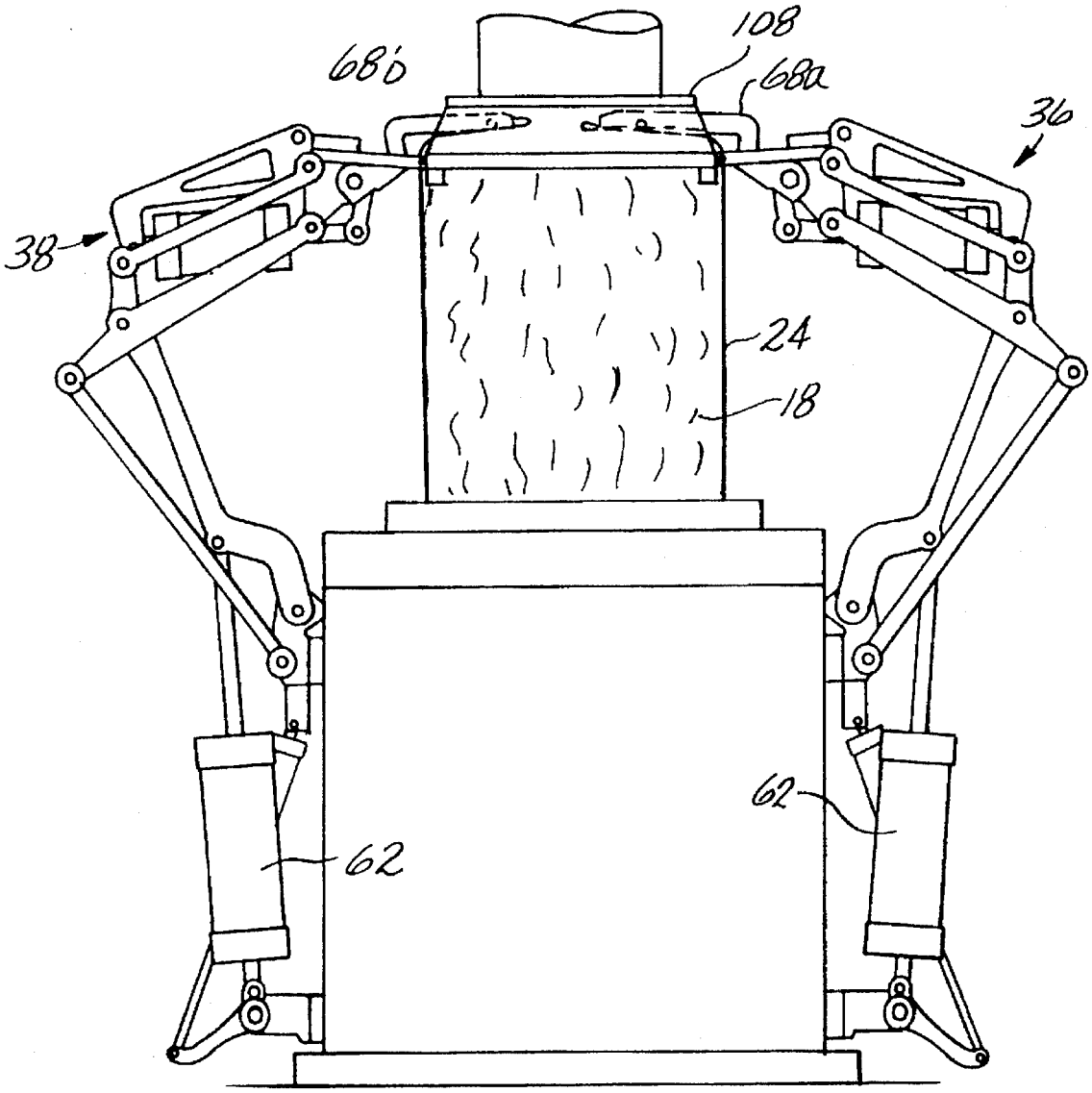
FIG. 9 is a semi-schematic, fragmentary end view of the tying device of FIG. 8 at a fourth stage in the wire-tying operation after both the front and back side arm assemblies have been pivoted to their fully extended positions.

Referring now to FIG. 9, after a time delay of sufficient length to allow the fingers to be pivoted to their fully bent positions, the control circuit further automatically operates the pneumatic cylinders 62 on the first wire bend assembly 36 to extend and pivot the arms of the first wire bend assembly upwardly from the partially-extended load position to its fully extended position. The first wire bend assembly operates to move the finger assemblies through approximately 90° of arc, thereby bending the first pre-formed ends 30 of the wires 24 upwardly around the operator's, or load, side of the bale 18. After an additional time delay, the control circuit automatically operates the pneumatic cylinders 62 on the second wire bend assembly 38 to extend and pivot the second wire bend assembly upwardly from its partially-raised load position to its fully extended position. The second wire bend assembly likewise operates to bend the second pre-formed ends 32 of the wires 24 upwardly around the rear, or unattended, side of the bale.

The time delay between the start of pivoting and extension of the first wire bend assembly 36 and the start of pivoting and extension of the second wire bend assembly 38 is sufficient to provide that the first assembly is in its fully extended position holding the first pre-formed ends 30 of the wires 24 in proper position in the wire closers, while the second wire bend assembly continues its pivot toward its fully extended position. Thus, the second wire bend assembly moves the second pre-formed ends 32 of the wires into their respective wire closers only after the first pre-formed ends have been properly positioned in the closers for engagement with the second ends.

As can be seen by referring to FIG. 9, the wire bend assemblies continue their upward pivot so that the first interlocking ends 30 of the wires 24 are placed into proper position in the wire closer assembly 108, first followed by insertion into the closer assembly of the second interlocking ends 32 of the wires.

Figure 10:
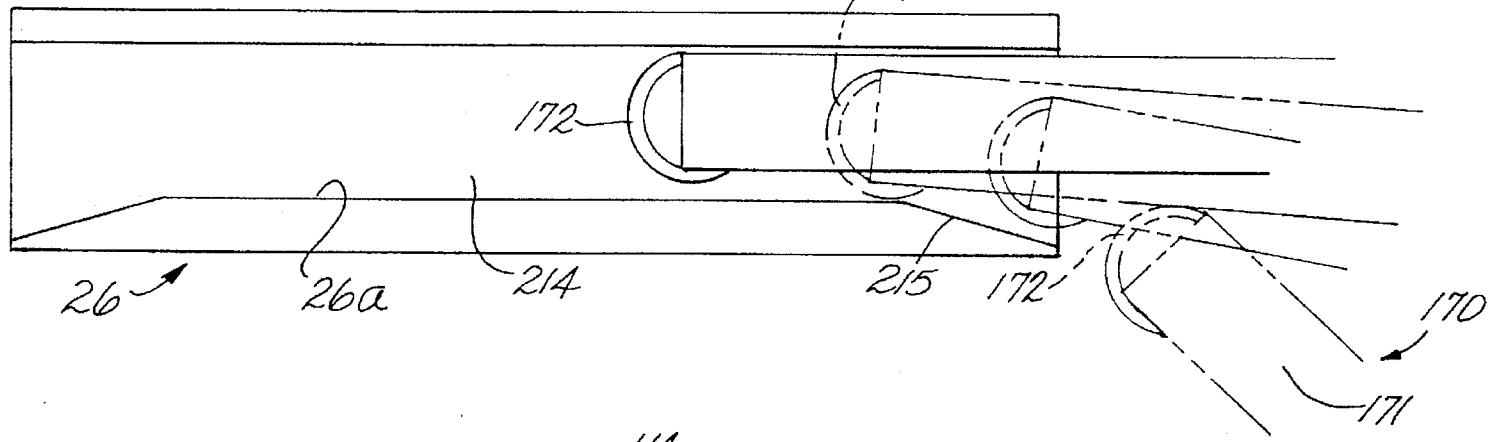
FIG. 10 is a semi-schematic, fragmentary cross-sectional view of the travel motion of a cam arm assembly as a wire bend assembly is pivoted to its fully extended position.
Figure 11:
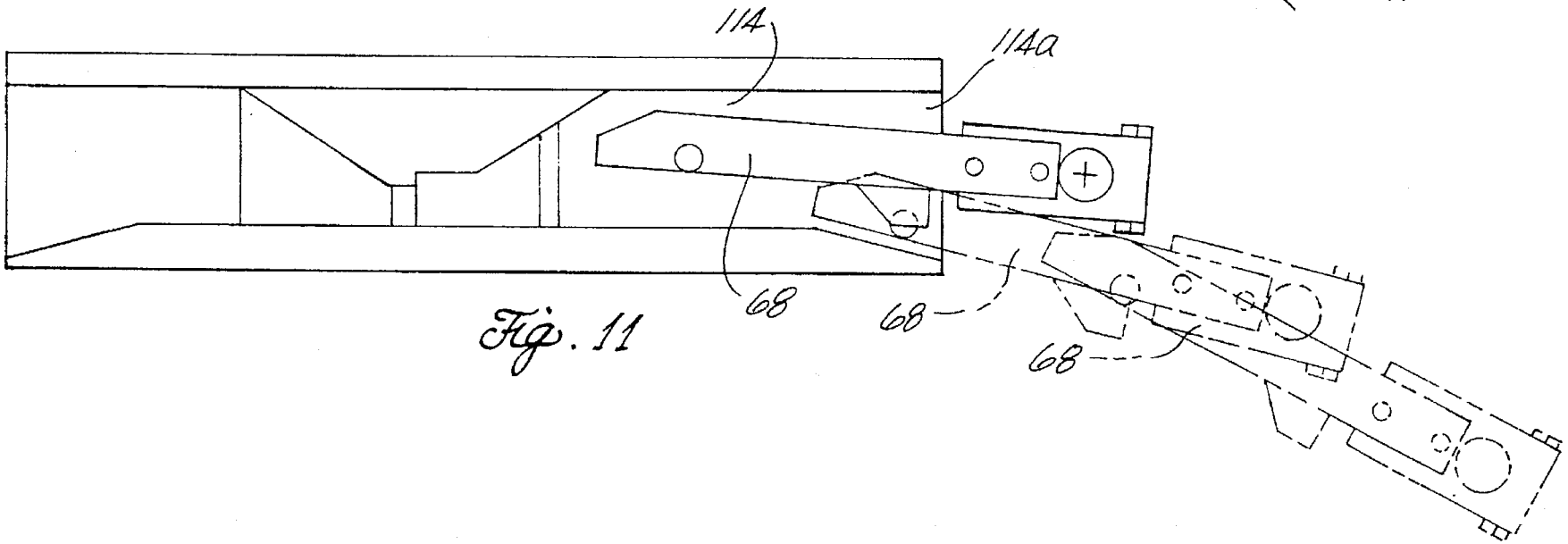
FIG. 11 is a semi-schematic, cross-sectional view of a finger assembly as it is guided into a closer cavity by action of the cam arm assembly.

Referring now to FIGS. 10 and 11, the fingers 68 are guided into proper position in their respective closer cavities 114 by the cam arm assembly 170. Once the follow block is in proper position, and the bend assemblies are in the process of pivoting to their fully extended positions, the cam arm assembly 170 is directed into its own associated guide cavity 214 by virtue of its connection to the wire bend assembly 36. As the cam arm assembly 170 (as best seen in FIG. 10) begins to enter the guide cavity 214, the roller 172, at the distal end thereof, engages a bevel 215 provided at the leading edge of the bottom surface of the guide cavity.

As the roller 172 is moved along the bevel 215, the cam arm 171 to which the roller 172 is attached, is forced upward, into a more obtuse angle with respect to the follow block assembly. As the cam arm 171 is forced upward, the cam arm, in turn, applies a torque to arm 69 of the wire bend assembly 36 which, in turn, forces the finger 68, attached thereto, into the same angle with respect to the follow block assembly. This motion deflects the tips of the fingers 68 into the center of their respective openings 114*a*, thereby guiding the finger 68 into their associated closer cavity 114 between the fingers, and the wires carried by the fingers with the exterior structure of the follow block.

As is clear from FIGS. 10 and 11, the angular position of the cam arm assembly 170 controls the angular position of the finger 68 as they travel along the closer cavity 114. The angular position of the finger 68 ensures that their associated wires 24 are suspended in the correct position in the closer cavity 114 for eventual engagement with the wires of the second wire bend assembly, in a manner to be described more fully below.

Figure 12:
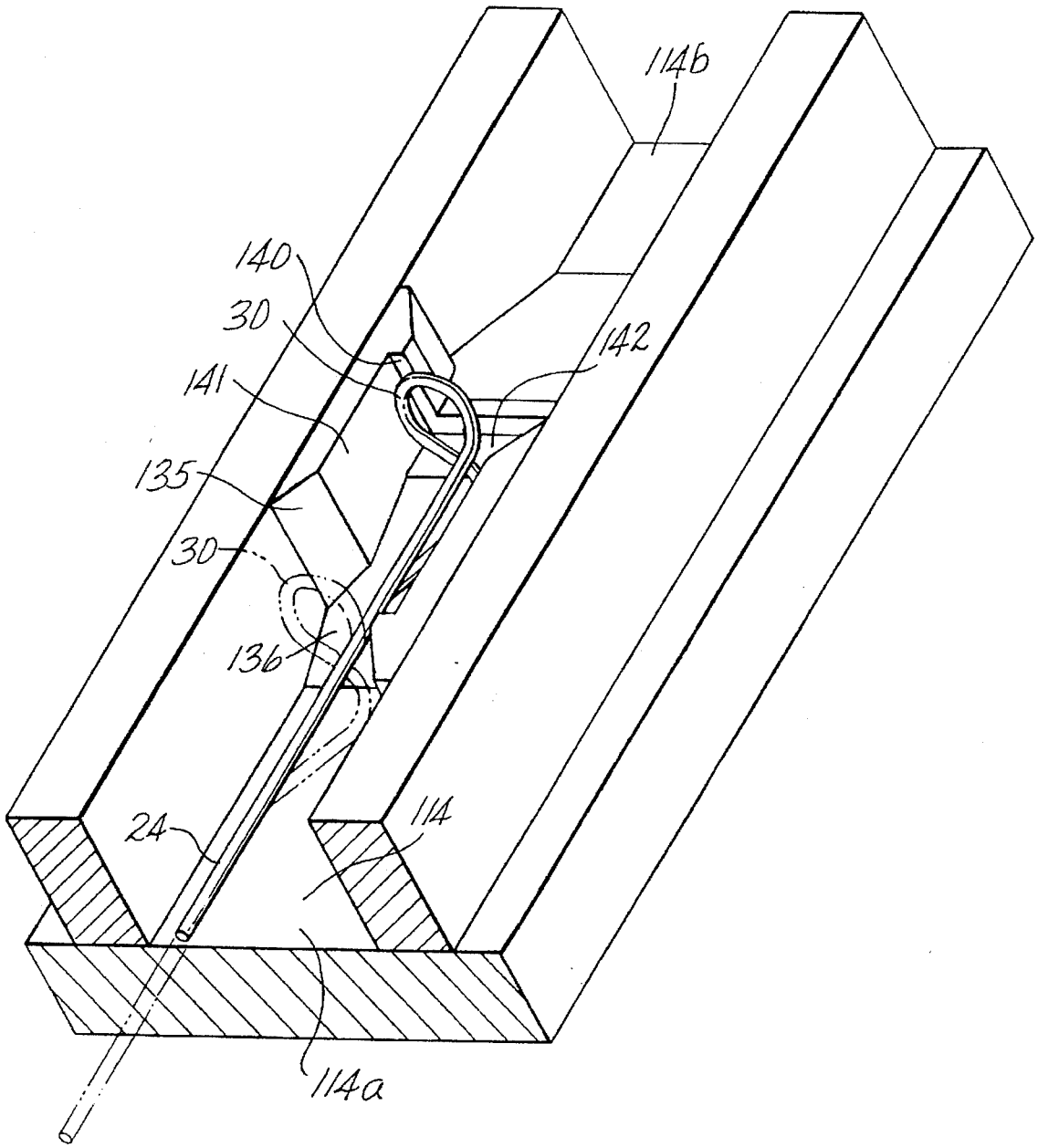
FIG. 12 is a semi-schematic, enlarged perspective, fragmentary view of a wire closer of the wire-tying device in accord with the invention illustrating an early stage of the sequence of joining the pre-formed interlocking ends of one of the wires together in the closer.
Figure 13:
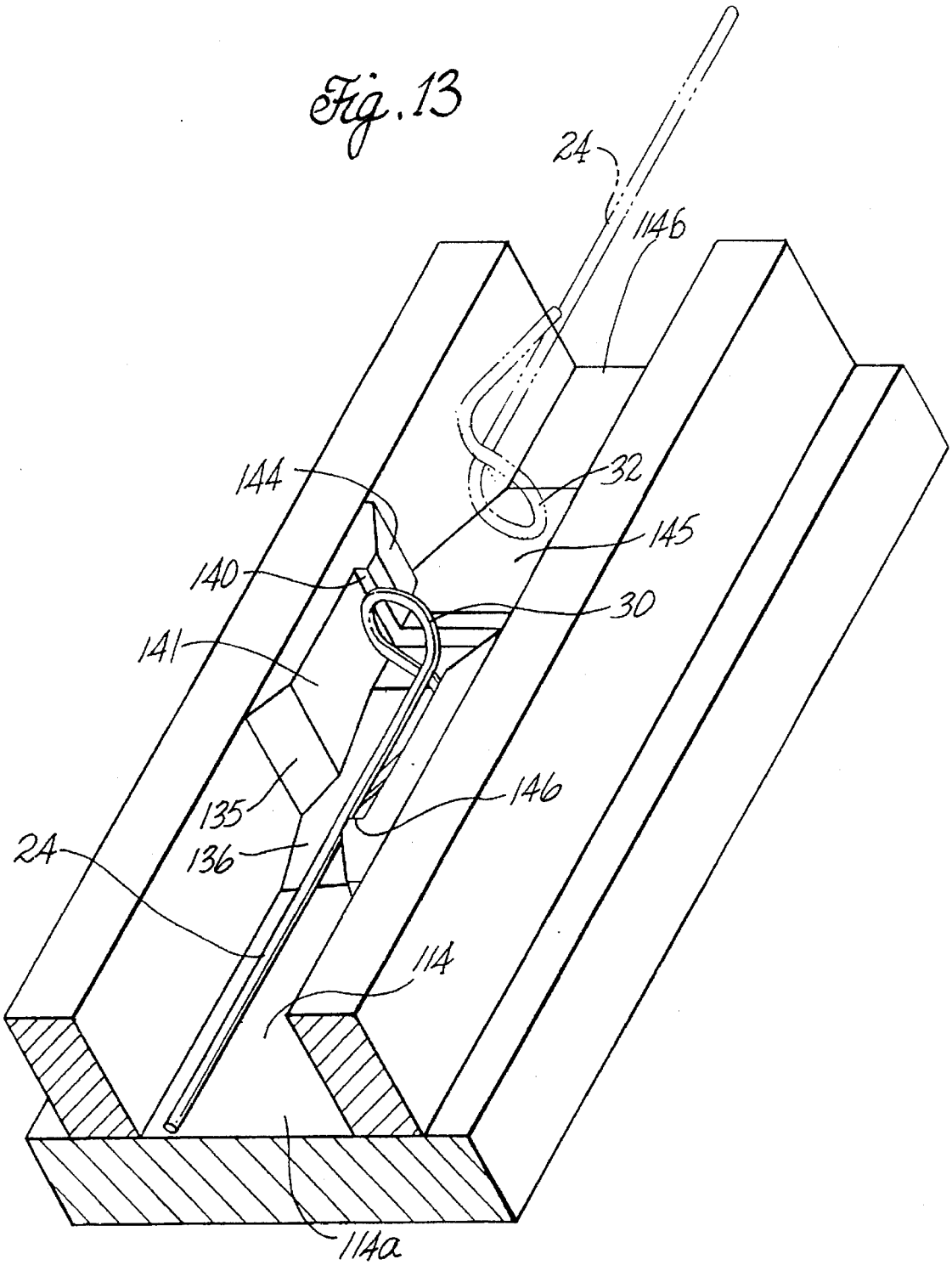
FIG. 13 is a semi-schematic, enlarged perspective, fragmentary view of the wire closer of FIG. 12 illustrating a later stage of the sequence of joining the pre-formed interlocking ends of one of the wires together in the closer.
Figure 14:
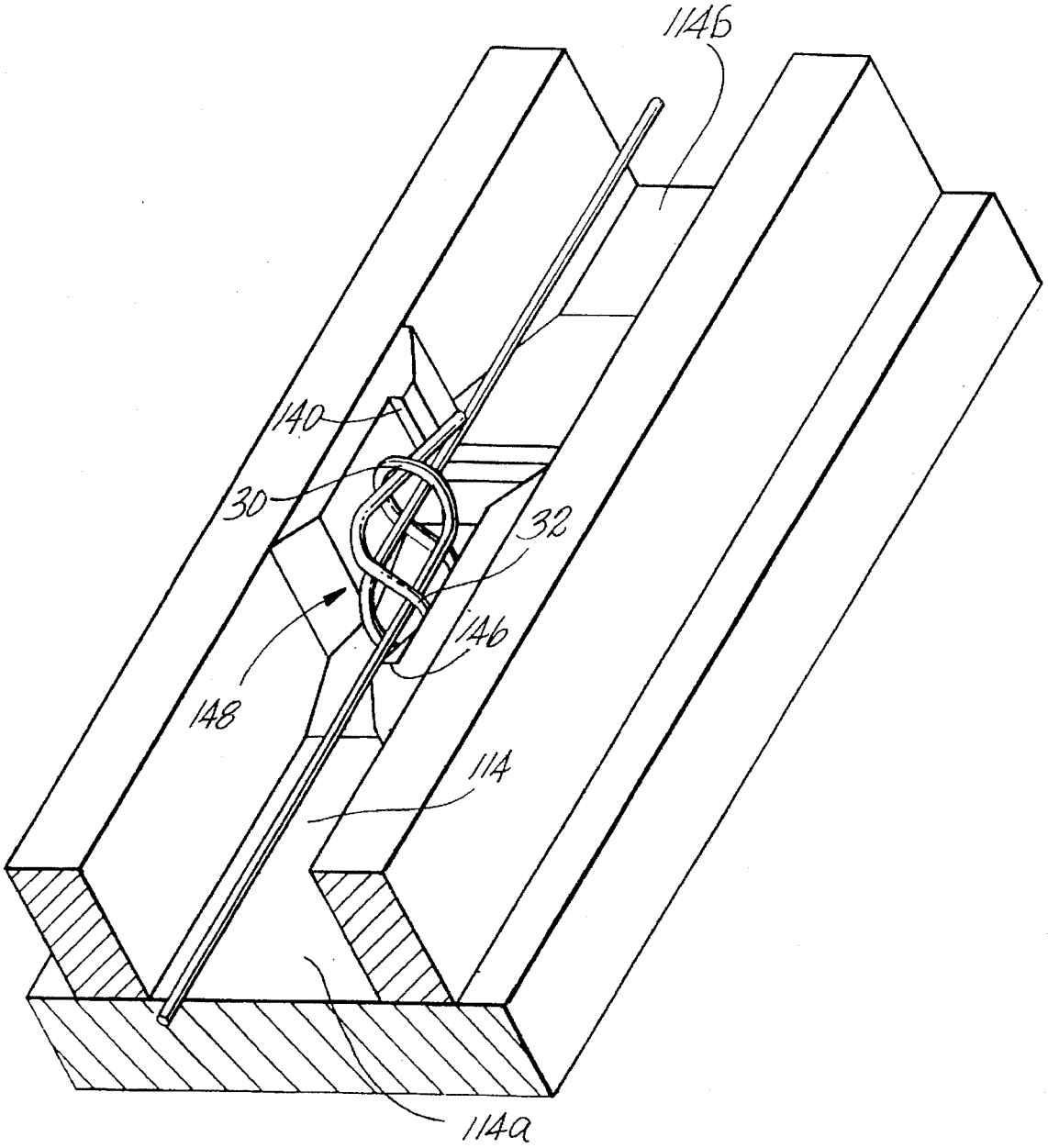
FIG. 14 is a semi-schematic, enlarged perspective, fragmentary view of the wire closer of FIG. 13 illustrating the final stage of the sequence of joining the pre-formed interlocking ends of one of the wires together in the closer.

The sequence of insertion of the interlocking ends of the wires, into the wire closers, the manner in which the wires are joined together in the closers, and additional details of construction of the closers can best be understood by referring to FIGS. 4 and 12–14. As was the case with the illustration of the follow block of FIG. 4, the wire closer illustrations of FIGS. 12–14 are provided upside-down for illustrational clarity and simplicity of description. Accordingly, in the views of FIGS. 12–14 of the orientation is through the top surface 110 of the follow block structure 108 as depicted in FIG. 4.

Referring first to FIGS. 4 and 12, due to the above-described pre-programmed automatic sequencing of the arm assemblies, the first interlocking end or loop 30 of each wire 24 enters the end 114*a* of the cavity 114 of its respective closer 112 for the second interlocking end 32 (not shown) enters the opposite end 114*b* of the cavity. As the loop 30 of the wire 24 (shown in phantom lines in FIG. 11) passes through the cavity 114, the tip of the loop 30 (which is oriented in a vertical plane and which plane is bent towards the side of the cavity) contacts and is guided along a bevel 135 which extends horizontally into the cavity 114 in the direction of the plane. The loop is biased against the bevel 135 by the mechanical spring pressure of the wire 24 and thus the path and lateral position of the loop 30 in the cavity is determined by the bevel 135. Loop 30 of the wire 24 is pushed along a wire closer ramp 136 in the cavity 114 as the first bend assembly 36 continues to pivot towards its fully extended position. The tip of the loop 30 is then guided to rest against a stop 140 by an interior wall surface 141 against which the loop tip slides as the loop is pushed forward into the closer cavity.

The loop 30 of each such wire 24 is held securely against movement back and forth against the stop 140 by the first wire bend assembly 36 when it is in its fully lowered position. The loops 30 are restricted from moving up or down by pressure from the bottom surface, 142, of the closer structure. The surface extends vertically into the closer cavity 114, so as to define a generally narrow throated pocket in which the wire loops' freedom of motion is restricted. When the loops 30 of the wires (as shown in solid lines in FIG. 12) are in position, the loops are ready to be engaged and joined together with the ends or loops 32 of the second ends of the wire.

Referring next to FIG. 13, the loop 30 of the wire 24 is positioned in the closer assembly, as described above with reference to FIG. 12, while a second end or loop 32 of the wire 24 (shown in phantom in FIG. 13) enters the end 114B of the wire closer cavity 114*b* and is pushed into the cavity 114 by the second bend assembly 38 as it moves toward its fully extended position. The loop 32 is biased into proper alignment for mating with the loop 30 by a second bevel 144 provided at the opposite leading edge of the interior wall surface 141 from the first bevel 135. The loop 32 is biased against the bevel 144 because of the positioning of the fingers 68 in the closer cavity 114 by action of the cam arm 170. The loop 32 is pushed up a second wire closer ramp 145, as the second bend assembly 38 pivots towards its fully extended position, until the tip of the loop abuts a second stop 146.

Because the loops 30 and 32 are oriented in a substantially vertical plane, the combination of bevels 135 and 144, ramps 136 and 145, and stops 140 and 146, function to guide the loops into proper position for interlocking, and hold the loops in place, against vertical or lateral movement, once the interlocking ends have engaged one another. The vertical orientation of the loops allows the wires and loops to be biased into proper position by, for example, the bevels 135 and 144, without the torquing and other misalignment problems associated with free-floating horizontally oriented loops.

As can be seen in FIG. 14, the loop 32 of the wire 24 engages the loop 30 after the loop 32 has been pushed past the loop 30 by the second arm assembly 38. When the second arm assembly 38 is in its fully extended position, the loop 32 is adjacent the second stop 146. Likewise, when the first arm assembly 36 is in its fully extended position, the loop 30 is adjacent its corresponding stop 140.

When the first and second ends 30 and 32 of the wires 24 are engaged, as shown in FIG. 14, and the second bend assembly 38 has reached its fully extended position (as is shown in FIG. 9), the control circuit automatically operates the pneumatic gripper assembly cylinders on both the finger assemblies, by means of a limit switch (not shown). Operation of the pneumatic cylinders opens all of the gripper assemblies and releases the wires 24 from the wire bend assemblies 36, 38. Although the wires are released from the wire bend assemblies when the gripper assemblies are opened, so long as the bend assemblies are in their fully extended position, the wires are held in the position shown in FIG. 14.

After a selected time delay provided by the control circuit that begins when the gripper assemblies are opened, the control circuit automatically operates the pneumatic cylinder on the wire bend assembly 36 to start pivoting the assembly 36 from its fully extended position to its fully retracted position. As the assembly 36 begins moving downwards, it disengages the wires 24 to allow the loops 30 and 32 to spring back from their positions against the stops 140 and 146 and move in a direction toward the closer cavity openings **114*a* and 114*b*. Such movement continues until the ends 30 and 32 form a tight knot indicated generally at 148 (best seen in FIG. 14), which is stopped from further movement out of the cavity 114 by the stops 140 and 146. The knot 148 is, thereby, positioned and securely held directly below the enlarged portion 116*a* of the slot 116 so that the wire and knot formed therein can exit the closer cavity 114** through the slot.

In the reverse of the process described above, as the first bend assembly is being pivoted back down to its fully retracted position, and after the knot has been formed, the control circuit operates to begin pivoting the second wire bend assembly back from its fully extended position to its fully retracted position. The workmen then raises the press ram which releases the compression on the bale, thereby allowing the bale to expand within the wires which now tightly encircle the tied bale.

After the assemblies 36 and 38 have been returned to their fully retracted position, as described the preceding paragraph, the tied bale 18 is removed from the press. The press base plate is now released, leaving it free to pivot, in a turntable like manner, about the central pivot post, thereby rotating a next box full of cotton into a position beneath the down-packer press ram for compression into a bale. After the turntable, comprising the down-packer press base plate is secured from further rotation, the press doors are closed so that the arm assemblies 36 and 38 may be raised to the load position so that wire loading and the tying sequence can be repeated for the next bale.

The wire-tying device 10 of the present invention has been described with regard to a particular embodiment of a follow-block and wire closer adapted to guide the pre-formed looped ends of a bale tying wire into a knotting position. While the illustrated embodiment is advantageous in its ability to allow the pre-formed interlocking ends of a wire to interlock together properly, the particular embodiment illustrated is not required to properly operate the tying device 10. In particular, various other wire closers are suitable to be adapted to either the follow block structure of the present invention or, alternatively, adapted to be mounted on and formed integral with the fingers 68 of the tying device of the present invention. For example, U.S. Pat. No. 3,477,363 to Trumbo the disclosure of which is expressly incorporated herein by reference, describes an alternative wire closer structure for guiding horizontally oriented loops of bale tying wires together and which secures one end against movement during the knot-tying operation.

In addition, U.S. Pat. No. 3,863,558 to Trumbo, the disclosure of which is also expressly incorporated herein by reference, discloses a 2-piece wire closer which may be readily adapted for mounting on the ends of the fingers of the present invention.

It will be evident to one having skill in the art that a variety of wire closer structures and techniques are suitable as alternatives to the embodiment illustrated in connection with FIGS. 4 and 12–14. All that is required, in terms of the present invention, is that the ends of the bale tying wire be held in a particular orientation with respect to one another and that they be guided into interlocking relationship, without undue misalignment, to thereby form a knot.

The above description of a preferred embodiment of the wire-tying device 10 provided in accordance with this invention, and its automatic operation, is solely for illustrative purposes. Because of the considerable variations which may be made by those skilled in the art to the arm assemblies, the finger assemblies, the gripper assemblies, and the specific structure of the wire closers, the present invention is not intended to be limited to the embodiment described above but is intended to embrace all alternatives, variations and equivalents falling within the scope of the invention as defined by the following claims.

What is claimed is:

1. A wire tying device for mounting on a down-packer type baling press in which cotton is boxed for baling at a loading side of a substantially horizontal rotating turntable, which turntable rotates the cotton box to position it beneath a press ram oriented to compress the cotton into a bale by applying pressure from above, the turntable defining a base plate, when rotated into the pressing position, against which the cotton is compressed, the tying device mounted below the turntable base plate for tying wire having pre-formed interlocking ends around a bale formed in the down-packer press, the tying device comprising:

first and second wire bend assemblies pivotally mounted on opposite sides of the baling press for holding and bending first and second pre-formed interlocking ends of a wire upwardly around a compressed bale as each bend assembly pivots from a first wire loading position to a second fully extended position, the first and second wire bend assemblies including means for retracting said assemblies downwardly away from the wire loading position to a fully retracted position below the horizontal rotational arc of the turntable.

2. A tying device in accordance with claim 1, further comprising:

a movable follow block mounted on the bale press ram having a bottom surface which forms the top of a chamber in which the bale is compressed, the follow block moving against the bale in order to compress the bale in the chamber; and wire closer means for interlocking engagement of the wires, wherein the first pre-formed end of the wire is held by the first wire bend assembly as the second pre-formed end of the wire is moved into interlocking engagement with the first end.

3. A tying device in accordance with claim 2, wherein the wire closer means comprises an elongated, open-ended cavity extending across the length of the closer means, the first pre-formed end of the wire being inserted into a first end of the cavity by the first wire bend assembly as the assembly is pivoted upwardly, and the second pre-formed end of the wire being inserted into a second end of the cavity by the second wire bend assembly as the assembly is pivoted upwardly.

4. A tying device in accordance with claim 2, wherein each wire bend assembly further comprises:

a positioning assembly including a pivotally movable shaft at the distal end thereof;

an arm assembly mounted on the shaft and capable of being pivoted upwardly from a fully retracted to a fully extended position; and a finger assembly mounted on the arm assembly, the finger assembly comprising a plurality of horizontally spaced-apart fingers each of which can be pivoted upwardly from a fully retracted to a fully extended position, each such finger on the first wire bend assembly being associated with a counterpart finger on the second wire bend assembly, the wire bend assembly is constructed so that when both the arm assemblies and the fingers comprising the first and second wire bend assemblies are in their fully extended positions, and the wires to be tied around the bale are positioned in the tying device for tying, each such wire is held on one end by one of the fingers of the first wire bend assembly and extends across the baling press such that the second end of such wire is underneath the counterpart finger of the second wire bend assembly.

5. A tying device in accordance with claim 4, the wire closer means comprising a plurality of horizontally spaced-apart wire closers, each comprising a cavity open on both ends for insertion of the opposite ends of the wires, each such wire closer further comprising means for holding the first interlocking end of such wire in proper position therein so that when the second pre-formed interlocking end of such wire is inserted into the wire closer, such interlocking ends are joined together.

6. A tying device in accordance with claim 5 wherein said finger assemblies each further comprise guide means for guiding the first interlocking end of the wire into position in the wire closer cavity and for guiding the second interlocking end of wire into interlocking engagement with the first end, the guide means operatively responsive to the motion of the wire closer assembly as it moves toward the fully extended position.

7. A tying device in accordance with claim 6 wherein the guide means comprises a cam arm assembly coupled to the finger assembly and operatively controlling angular position of the finger assembly, the cam arm assembly including a cam roller for engaging the wire closer assembly, the cam roller entering a corresponding cavity of the wire closer assembly thereby guiding the finger assembly fingers into the open ends of their corresponding cavities.

8. A tying device in accordance with claim 4 wherein the arm assembly comprises extending, articulated lever arms.

9. A tying device in accordance with claim 4 further comprising positioning means coupled to the positioning assembly for raising the positioning assembly to thereby partially extend the finger assembly into a wire load position, such that the fingers are disposed within the horizontal rotational plane of the turntable base plate.

10. A tying device in accordance with claim 1, wherein each arm assembly comprises means for forming an about 90° bend in the wire adjacent both the first and second pre-formed ends.

11. A wire tying device for mounting on a down-packer type baling press in which cotton is boxed for baling at a loading side of a substantially horizontal rotating turntable, which turntable rotates the cotton box to position it beneath a press ram oriented to compress the cotton into a bale by applying pressure from above, the turntable defining a base plate, when rotated into the pressing position, which comprises the floor of a chamber in which the bale is formed and against which the bale is compressed, the tying device mounted below the turntable base plate for tying wire having pre-formed interlocking ends around the bale formed in the down-packer press, the tying device comprising:

a first wire bend assembly pivotally mounted on one side of the base plate for holding and bending a first pre-formed interlocking end of a wire upwardly around one side of the bale as the assembly pivots from a fully retracted to a fully extended position;

a second wire bend assembly pivotally mounted on the opposite side of the base plate for holding and bending a second pre-formed interlocking end of the wire upwardly around the opposite side of the bale as the assembly pivots from its fully retracted to its fully extended position;

first and second finger assemblies mounted on respective ends of the first and second wire bend assemblies, the finger assemblies comprising a plurality of horizontally spaced-apart fingers each of which can be pivoted upwardly from a fully retracted to a fully extended position, each such finger on the first finger assembly being associated with a counterpart finger on the second finger assembly, the wire bend assemblies constructed so that when both the finger assemblies and the first and second wire bend assemblies are in their fully extended positions the fingers extend across the bale such that the first and second interlocking ends of the wire are joined together.

12. The wire tying device in accordance with claim 11 wherein both the first and second wire bend assemblies comprise means for guiding the wires into proper position on the tying device for manual loading.

13. The tying device in accordance with claim 12 wherein the wire guide means comprises a guide tube assembly mounted on the turntable base plate of the press ram, each guide tube assembly comprising a plurality of horizontally spaced-apart elongated hollow guide tubes open at both ends, wherein each guide tube is associated with one of the fingers and is aligned in a direction about parallel to such a finger when the finger is in its load position, the wires, when in position on the tying device for tying around a bale, extending through such guide tubes.

14. A tying device in accordance with claim 13 wherein each finger assembly further comprises means for gripping each wire to be tied around the bale adjacent the first end of such a wire, such that the wires are maintained in proper position as they are bent around the bale.

15. A tying device in accordance with claim 14 wherein the wire gripping means comprises a gripper structure mounted on the wire bend assembly, the gripper structure comprising a plurality of anvil assemblies each comprising a pair of anvil arms having opposed, inwardly facing anvil blocks, wherein an anvil arm, when pivoted to a first position, opens the anvil assembly so that a wire can be positioned between the anvil blocks in the anvil assembly and wherein such an anvil arm, when pivoted to a second position, closes the anvil assembly to thereby hold the wire securely in place therein so that such a wire can be bent around the anvil by the finger associated with that wire when such a finger is pivoted from its load position to its fully extended position.

16. A tying device in accordance with claim 15 wherein each such anvil assembly comprises a spring which biases each pair of anvil arms toward their closed position for holding the wire securely in position between the opposed faces of their associated anvil blocks.

17. A tying device in accordance with claim 11 further comprising:

a movable follow block mounted on the bale press ram having a bottom surface which forms the top of a chamber in which the bale is compressed, the follow block moving against the bale in order to compress the bale in the chamber; and wire closer means for interlocking engagement of the wires, wherein the first pre-formed end of the wire is held by the first wire bend assembly as the second preformed end of the wire is moved into interlocking engagement with the first end.

18. A tying device in accordance with claim 17 wherein the wire closer means comprises a stop for placing a knot formed by the interlocking ends of the wire in proper position for removal from said wire closer means.

* * * * *